US010179593B2

(12) United States Patent
Bidault

(10) Patent No.: US 10,179,593 B2
(45) Date of Patent: Jan. 15, 2019

(54) MOTORIZED CARRIAGE THAT IS MOVABLE IN TRANSLATION ON A RAIL

(71) Applicant: TEB, Corpeau (FR)

(72) Inventor: Louis Bidault, Santenay (FR)

(73) Assignee: TEB, Corpeau (FR)

( * ) Notice: Subject to any disclaimer, the term of this patent is extended or adjusted under 35 U.S.C. 154(b) by 337 days.

(21) Appl. No.: 15/116,655

(22) PCT Filed: Jan. 26, 2015

(86) PCT No.: PCT/FR2015/050173
§ 371 (c)(1),
(2) Date: Oct. 31, 2016

(87) PCT Pub. No.: WO2015/118244
PCT Pub. Date: Aug. 13, 2015

(65) Prior Publication Data

US 2017/0050647 A1 Feb. 23, 2017

(30) Foreign Application Priority Data

Feb. 4, 2014 (FR) ..... 14 50843

(51) Int. Cl.
*B61C 13/04* (2006.01)
*B66C 9/02* (2006.01)
(Continued)

(52) U.S. Cl.
CPC ..... *B61C 13/04* (2013.01); *B61C 3/00* (2013.01); *B66C 9/02* (2013.01); *B66C 9/12* (2013.01); *B61B 3/02* (2013.01)

(58) Field of Classification Search
CPC .. B66C 9/02; B66C 9/12; B61C 13/04; B61C 3/00; B61B 3/02
See application file for complete search history.

(56) References Cited

U.S. PATENT DOCUMENTS 2,365,819 A * 12/1944 Herrick ..... B66C 9/12 105/180
4,382,413 A * 5/1983 Kakehi ..... B66C 9/10 105/163.1
2017/0050647 A1* 2/2017 Bidault ..... B66C 9/02

FOREIGN PATENT DOCUMENTS

CA 2121651 A1 * 9/1994 ..... B66C 9/08
CA 2121651 A1 9/1994
(Continued)

OTHER PUBLICATIONS

International Search Report dated Mar. 23, 2015 re: Application No. PCT/FR2015/050173, pp. 1-3.

*Primary Examiner* — Jason C Smith
(74) *Attorney, Agent, or Firm* — Cantor Colburn LLP

(57) ABSTRACT

Motorized carriage (1) that is able to move in translation along a longitudinal axis (X) along a horizontal rail, said carriage (1) comprising at least one wheel (4), in particular of the friction wheel type, that is driven in rotation by an electric motor (5) and is mounted so as to pivot about a transverse axis (Y) on a holder (3) which carries said motor (5), said carriage (1) comprising a chassis (2) incorporating guide means (23, 24) mounted so as to slide on the chassis (2) along a vertical axis (Z) orthogonal to the longitudinal axis (X) and transverse axis (Y) and cooperating with elastic stressing means (25, 26) that are designed to move the guide means (23, 24) in the direction of the rail, where the holder (3) is in sliding contact with said guide means (23, 24) along the longitudinal axis (X) and vertical axis (Z), this sliding contact being designed to convert a movement of the holder (3) along the longitudinal axis (X) into a concurrent movement of the holder (3) along the vertical axis (Z) in the direction of the rail. Said carriage (1) can be used in video surveillance systems.

11 Claims, 2 Drawing Sheets

(51) Int. Cl.

| | |
|---|---|
| ***B66C 9/12*** | (2006.01) |
| ***B61C 3/00*** | (2006.01) |
| *B61B 3/02* | (2006.01) |

(56) References Cited

FOREIGN PATENT DOCUMENTS

| | | | | | |
|---|---|---|---|---|---|
| GB | 2265348 | A | * | 9/1993 | ..... B61B 13/04 |
| GB | 2265348 | A | | 9/1993 | |
| JP | 10330072 | A | | 12/1998 | |
| WO | 2009118637 | A1 | | 10/2009 | |
| WO | WO-2009118637 | A1 | * | 10/2009 | ..... B66C 9/12 |

* cited by examiner

MOTORIZED CARRIAGE THAT IS MOVABLE IN TRANSLATION ON A RAIL

TECHNICAL FIELD

The present invention relates to a motorized carriage capable of being displaced in translation along a horizontal rail.

More particularly, it relates to a carriage including at least one wheel, in particular of the frictional wheel-type, driven in rotation by an electric motor and pivotally mounted on a support which carries said motor.

BACKGROUND

The invention finds a particular, but non-limiting, application in the field of video surveillance systems integrating a suspended carriage movable in translation on a horizontal rail, where the carriage supports at least one camera mounted on its frame.

In the field of motorized carriages, the wheel(s) is/are driven in rotation by the electric motor and roll(s) and remain(s) in contact on the horizontal rail. When rolling, each wheel applies a force along a vertical axis (perpendicular to the rail) and, in a conventional manner, a balance is sought between the adherence and the pressure of each rail on the rail.

Indeed, a low pressure allows limiting the noise and the wear of the components (in particular of the wheels) but limits the adherence of the wheel on the rail, resulting in a risk of skidding of the wheel and consequently in a loss of the driveability of the carriage.

Conversely, a significant pressure of the wheel guarantees the adherence but generates rapid noise and a wearing of the components (in particular of the wheels). Moreover, with a high pressure of the wheel on the rail, part of the energy deployed by the motor is used to overcome the deformation of the materials, thereby an overconsumption of energy.

Furthermore, retaining either one of the two solutions, the low-pressure solution (in order to gain silence, limit wear and energy consumption) or the high-pressure solution (in order to enhance adherence and driveability), ultimately turns out to be limited because the rail often presents dimensions subject to variations, even slight variations, and such variations of the dimensions ineluctably make the pressure of the wheel on the rail vary.

BRIEF SUMMARY

The present disclosure aims in particular to solve all or part of these drawbacks, by proposing a motorized carriage which presents a significant longevity while limiting the wear of its components, and a use which is as silent as possible.

To this end, it proposes a motorized carriage capable of being displaced in translation along a longitudinal axis along a horizontal rail, said carriage including at least one wheel, in particular of the frictional wheel-type, driven in rotation by an electric motor and pivotally mounted along a transverse axis on a support which carries said motor, said carriage being characterized in that it includes a frame integrating guide means slidably mounted on the frame along a vertical axis orthogonal to the longitudinal and transverse axes and cooperating with elastic stressing means shaped to displace the guide means towards the rail, where the support is in sliding contact on said guide means along the longitudinal and vertical axes, this sliding abutment being designed to convert a displacement of the support along the longitudinal axis into a concomitant displacement of the support along the vertical axis towards the rail.

Thus, thanks to this sliding assembly, the invention allows making the pressure of the wheel on the rail vary depending on the force required to the displacement of the carriage. Indeed, when the carriage is stopped or moving at constant speed, the support is not displaced longitudinally and in this case, the elastic stressing means are slightly stressed so that the wheel applies a reduced pressure whereas, when the carriage is in a braking or in an acceleration phase, then the support is displaced longitudinally and in this case, the elastic stressing means are considerably stressed under the effect of the thrust exerted by the support which slides both longitudinally and vertically on the guide means, which results in an increased thrust of the wheel against the rail.

Thanks to the invention, the carriage allows exploiting at best the power of the motor while limiting the energy consumption and the wear of the components as much as possible.

The stressing means allow maintaining the contact between the wheel and the rail at a given minimum pressure when the carriage is stopped or moving at a constant speed, in particular in the aforementioned rest position of the support, and at an increased pressure when the carriage is in a braking or in an acceleration phase.

According to one feature, the support includes at least one bearing element mounted to slide on a corresponding guide part integrated to the guide means (and therefore to the frame), where the or each bearing element presents a bearing surface called front bearing surface adapted to come into sliding abutment on a guide ramp called front guide ramp provided on the corresponding guide part, where the front bearing surface and the front guide ramp extend in respective planes parallel to the transverse axis and inclined with respect to the longitudinal and vertical axes.

Thus, the aforementioned sliding assembly is made between the bearing element and the guide part, along the bearing surface which bears and slides against the guide ramp.

Advantageously, the or each bearing element presents a bearing surface called rear bearing surface adapted to come into sliding abutment on a guide ramp called rear guide ramp provided on the corresponding guide part, where the rear bearing surface and the rear guide ramp are symmetrical to the front bearing surface and to the front guide ramp respectively along planes orthogonal to the longitudinal axis.

In this conformation, the sliding abutment is ensured in both directions of displacement of the carriage, whether it is a forward displacement with the front bearing surface bearing and sliding against the front guide ramp, or a backward displacement with the rear bearing surface bearing and sliding against the rear guide ramp.

In a particular embodiment, the or each guide part presents front and rear guide ramps which converge towards a peak of the guide part, and the or each bearing element presents front and rear bearing surfaces which converge towards a hollow bottom of the bearing element.

Alternatively, the or each guide part presents front and rear guide ramps which converge towards a hollow bottom of the guide part, and the or each bearing element presents front and rear bearing surfaces which converge towards a peak of the bearing element.

In a general manner, the or each guide part has a shape complementary to the corresponding bearing element. When the peak of one of the parts (the guide part and the bearing element) bears on the hollow bottom of the other, then the support is in a position called rest position and the wheel applies a minimum pressure.

According to another feature, the or each guide part is in the form of a beveled or conical part cooperating with a bearing element having a complementary shape, or conversely, the or each bearing element is in the form of a beveled or conical part cooperating with a guide part having a complementary shape.

According to one possibility of the invention, the or each guide part is slidably mounted on the frame along the vertical axis.

According to another possibility of the invention, the elastic stressing means cooperate with the or each guide part so as to displace in translation the corresponding guide part in the direction of pressing the guide part against the corresponding bearing element of the support for pushing said support towards the rail.

In a particular embodiment, the or each guide part is slidably mounted inside the hollow guide secured to the frame, and the elastic stressing means include at least one elastic member, in particular of the spring-type, interposed between a bottom wall of the guide and the corresponding guide part.

In accordance with another advantageous feature of the invention, the support includes a first bearing element slidably mounted on a first guide part and a second bearing element slidably mounted on a second guide part, the first bearing element and the first guide part being shifted along the longitudinal axis with respect to the second bearing element and to the second guide part, in particular on either side of the wheel.

Thus, the sliding assembly of the support is made on two guide parts, for a balance of the forces and an optimum control of the sliding.

The present invention also concerns the feature according to which the support includes a central portion carrying the motor and on which the or each wheel is pivotally mounted, and the first and second bearing elements extend on either side of said central portion so as to cooperate in sliding abutment with the first and second guide parts.

The invention also relates to a video surveillance system integrating a suspended carriage movable in translation on a horizontal rail, where the carriage is in accordance with the invention and supports at least one camera mounted on its frame.

BRIEF DESCRIPTION OF THE DRAWINGS

Other features and advantages of the present invention will appear upon reading the detailed description hereinafter, of a non-limiting example of implementation, made with reference to the appended figures in which.

DETAILED DESCRIPTION

Figure 1:
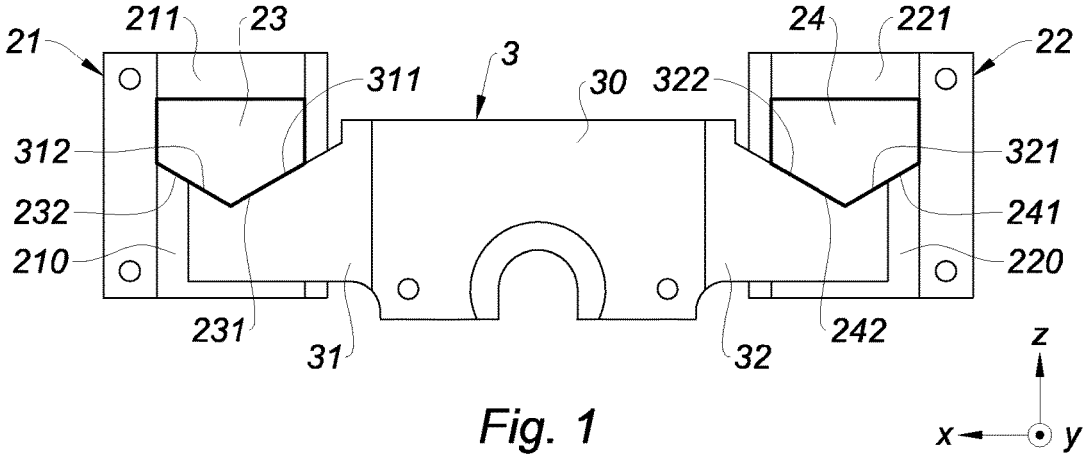
FIG. 1 is a schematic side view of a support cooperating with two guide parts slidably mounted in guides secured to a frame for a carriage in accordance with the invention.

For the following description, reference will usefully be made to the reference mark (X, Y, Z) presenting:

- a longitudinal axis X extending horizontally from backward to forward with reference to the direction of displacement of the carriage;
- a transverse axis Y extending horizontally from the right to the left and orthogonal to the longitudinal axis;
- a vertical axis Z extending from the bottom to the top and orthogonally to the horizontal plane (X, Y).

The motorized carriage 1 in accordance with the invention is intended to be displaced from forward to backward, and from backward to forward, on a horizontal rail (not represented) extending parallel to the axis X.

The carriage 1 includes a frame 2 and a support 3 slidably mounted on the frame 2, as well as at least one wheel 4 driven in rotation by an electric motor 5.

The wheel 4, of the frictional wheel-type, is intended to roll on the rail, under the effect of the rotation exerted by the motor 5. The wheel 4 is pivotally mounted along the axis Y on the support 3, and the motor 5 is in turn carried by this support 3.

The support 3 includes a movable plate 30 presenting a central portion on which are mounted the wheel 4 and the motor 5, and two arms 31, 32 extending on either side of the central portion 30 along the axis X, a first arm 31 of which forming a first bearing element and a second arm 32 forming a second bearing element.

The support 3 is symmetrical with respect to a midplane parallel to the plane (Y, Z), and each arm 31, 32 presents a V D-shaped end.

The first arm 31 presents a front bearing surface 311 extending in a plane parallel to the axis Y and inclined with respect to the axes X and Z. The second arm 32 also presents a front bearing surface 321 extending parallel to the front bearing surface 311.

The first arm 31 presents a rear bearing surface 312 extending in a plane parallel to the axis Y and inclined with respect to the axes X and Z, where the rear bearing surface 312 is symmetrical to the front bearing surface 311 along a plane orthogonal to the axis X. The second arm 32 also presents a rear bearing surface 322 extending parallel to the rear bearing surface 312.

Thus, each arm 31, 32 presents two front 311, 321, and rear 312, 322 bearing surfaces which converge towards a hollow bottom of the arm 31, 32 so as to define a « V » shape. The bearing surfaces 311, 312, 321, 322 comprise upper surfaces, in other words oriented upwards, opposite to the rail which is at the bottom.

Because of the symmetry of the support 3, the front bearing surface 311 of the first arm 31 is closer to the central portion of the plate 30 than the rear bearing surface 312, and conversely, the rear bearing surface 322 of the second arm 32 is closer to the central portion of the plate 30 than the front bearing surface 321.

The frame 2 includes a first and a second hollow guides 21, 22 each defining internally a housing 210, 220 extending along the direction Z and plugged at the top (or upper) portion by a bottom 211, 221.

The frame 2 includes a first guide part 23 slidably mounted in the first guide 21 along the axis Z, and a second guide part 24 slidably mounted in the second guide 22 along the axis Z.

Each guide part 23, 24 is in the form of a beveled or conical part terminated by a tip or a peak oriented downwards, towards the rail.

Each guide part 23, 24 presents two opposite guide ramps 231, 232, 241, 242 which converge towards the peak.

The first guide part 23 presents a front guide ramp 231 extending parallel to the front bearing surface 311 of the first arm 31, and a rear guide ramp 232 extending parallel to the rear bearing surface 312.

The second guide part 24 presents a front guide ramp 241 extending parallel to the front bearing surface 321 of the second arm 32, and a rear guide ramp 242 extending parallel to the rear bearing surface 322.

The frame 2 also includes a first and a second springs 25, 26 mounted respectively in the first and second guides 21, 22, the first spring 25 being interposed between the bottom 211 and the first guide part 23 so as to push the first guide part 23 downwards (towards the rail), and the second spring 26 being interposed between the bottom 221 and the second guide part 24 so as to push the second guide part 24 downwards.

The first arm 31 passes through the first guide 21 before penetrating inside its housing 210 and cooperating in sliding abutment with the first guide part 23, the front bearing surface 311 being adapted to come into sliding abutment on the front guide ramp 231, whereas the rear bearing surface 312 is adapted to come into sliding abutment on the rear guide ramp 232.

Similarly, the second arm 32 passes through the second guide 22 before penetrating inside its housing 220 and cooperating in sliding abutment with the second guide part 24, the front bearing surface 321 being adapted to come into sliding abutment on the front guide ramp 241, whereas the rear bearing surface 322 is adapted to come into sliding abutment on the rear guide ramp 242.

The support 3 can present the following three distinct positions, respectively a rest position, a forward-motion position and a backward-motion position.

Figure 3:
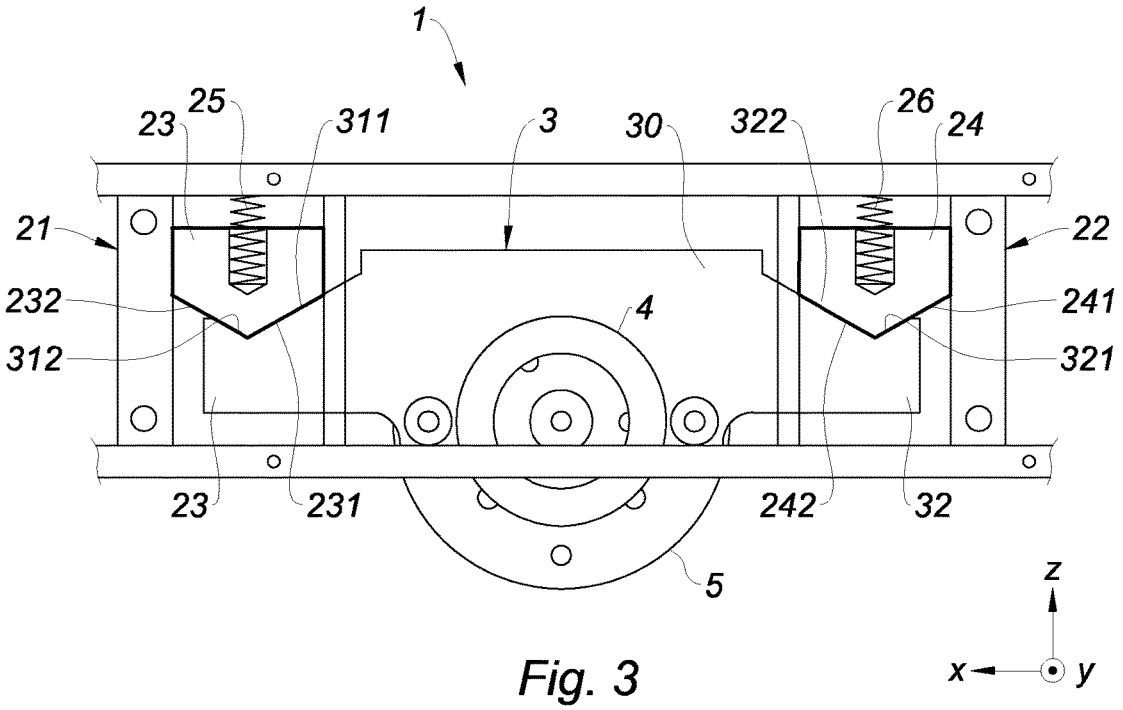

A rest position, illustrated in FIG. 3, is a position in which the peak of each guide part 23, 24 is in the bottom of the corresponding arm 31, 32, with the front bearing surface 311 bearing on the front guide ramp 231, the rear bearing surface 312 bearing on the rear guide ramp 232, the front bearing surface 321 bearing on the front guide ramp 241, and the rear bearing surface 322 bearing on the rear guide ramp 242.

Figure 2:
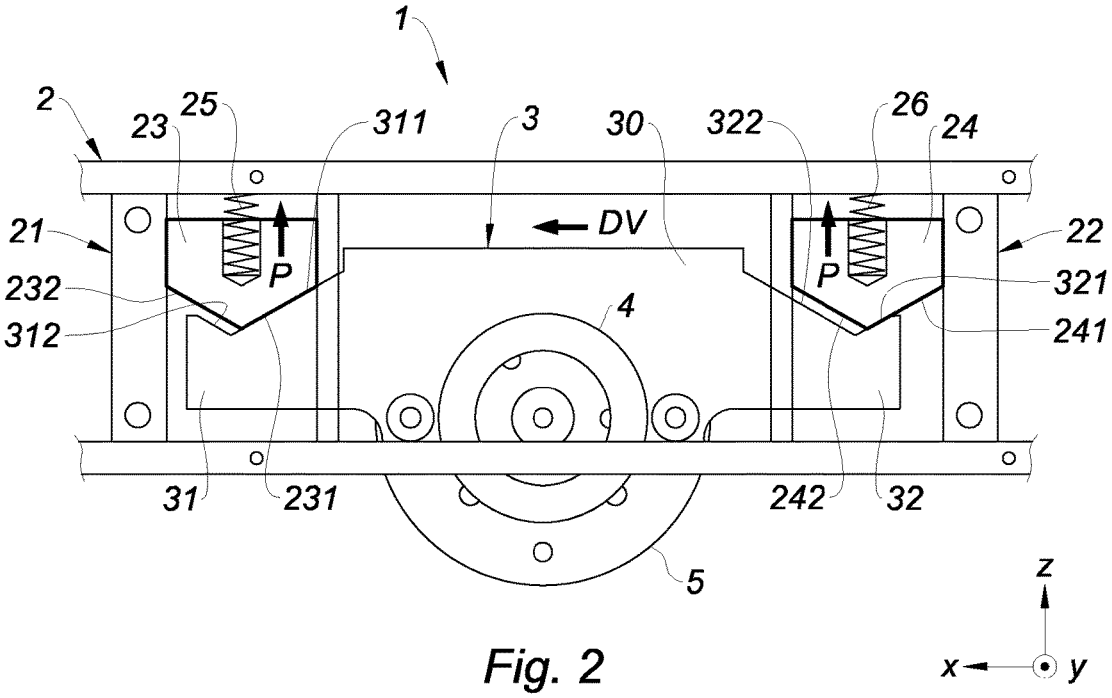
FIGS. 2 to 4 are schematic side views of a carriage in accordance with the invention integrating the elements of FIG. 1, when the carriage is respectively in a forward acceleration phase (FIG. 2), in a stop phase or in a constant speed movement phase (FIG. 3) and in a backward acceleration phase (FIG. 4).

A forward-motion position, illustrated in FIG. 2, is a position in which the support 3 has been displaced longitudinally forwards (arrow DV) resulting, on the one hand, into a sliding of the front bearing surfaces 311, 321 against the front guide ramps 231, 241 and, on the other hand, into a detachment of the rear bearing surfaces 312, 322 vis-à-vis the rear guide ramps 232, 242, so that:

- in a situation where the wheel 4 would not rest on a rail, the support 3 is guided in translation vertically downwards concomitantly with its longitudinal displacement forwards;
- in a situation where the wheel 4 rests (rolls) on a rail which is fixed, the support 3 cannot be displaced vertically downwards (towards the rail), and in this case, the longitudinal displacement of the support 3 forwards is converted into a vertical thrust of the guide parts 23, 24 upwards (arrows P), thereby stressing the springs 25, 26, so that the pressure applied by the wheel 4 against the rail is increased.

Figure 4:
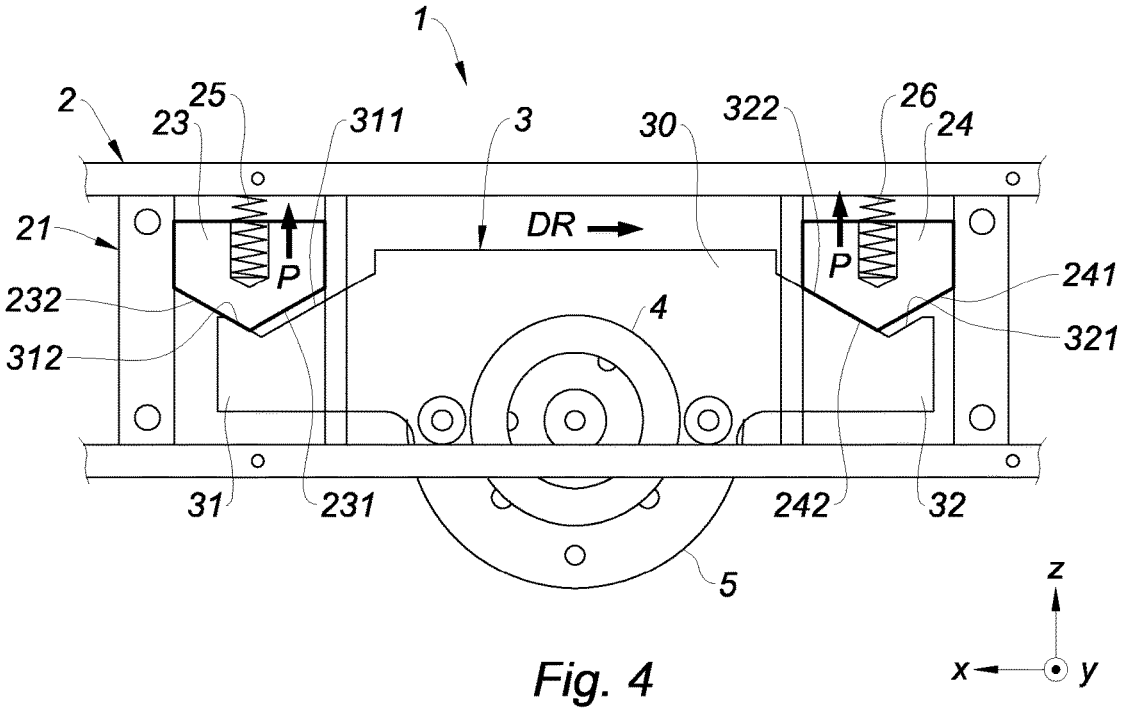

A backward-motion position, illustrated in FIG. 4, is a position in which the support 3 has been displaced longitudinally backwards (arrow DV) resulting, on the one hand, into a sliding of the rear bearing surfaces 312, 322 against the rear guide ramps 232, 242 and, on the other hand, into a detachment of the front bearing surfaces 311, 321 vis-à-vis the front guide ramps 231, 241, so that:

- in a situation where the wheel 4 would not rest on a rail, the support 3 is guided in translation vertically downwards concomitantly with its longitudinal displacement backwards;
- in a situation where the wheel 4 rests (rolls) on a rail which is fixed, the support 3 cannot be displaced vertically downwards (towards the rail), and in this case, the longitudinal displacement of the support 3 backwards is converted into a vertical thrust of the guide parts 23, 24 upwards, thereby stressing the springs 25, 26, so that the pressure applied by the wheel 4 against the rail is increased.

The following description relates to the operation of the carriage in an acceleration or in a braking phase.

When the drive wheel 4 starts rotating or accelerates, driven by the motor 5, it tends to displace the movable plate 30 along the axis X (forwards or backwards). As explained before, any displacement of the support 3 along the axis X results in a displacement of the guide parts 23, 24 along the axis Z, so that we get in the forward-motion or backward-motion position described above, and the support 3 presses the drive wheel 4 further against the rail.

Thus, the more the motor 5 accelerates, and the further the support 3 is displaced along the axis X and therefore the more the guide parts 23, 24 are pushed upwards, and therefore the more the adherence of the drive wheel 4 on the rail increases, thereby allowing to avoid any skidding.

During the acceleration of the carriage 1, the pulling forces provided by the motor 5 are significant, thereby increasing the pressure of the wheel 4 on the rail and therefore the adherence of the wheel 4.

The following description relates to the operation of the carriage in a steady state phase, in other words in a stop phase or in a constant speed movement phase.

When the carriage 1 is displaced at a uniform speed, the rail being horizontal, the motor 5 simply has to compensate the losses of speed due to the frictions. Thus, the pulling forces provided by the motor 5 are low and therefore the displacement of the support 3 along the axis X is almost zero, so that we get in the rest position described above. Hence, the pressure of the wheel 4 on the rail is minimum and is determined by the stiffnesses of the springs 25, 26, thereby limiting the deformation of the rail and therefore the energy losses. Thus, the energy consumption of the motor 5 decreases as well as the wear of the drive wheel 4, of the motor 5 and of the bearings.

In conclusion, the above-described carriage 1 allows displacing a carriage 1 on a rail while optimizing, on the one hand, the use of the power of the motor 5 and, on the other hand, the lifespan of the components involved in the transmission of the movement. Furthermore, this system with the support 3 and the guide parts 23, 24 is strictly mechanical and does not consume energy for the regulation of the pressure of the wheel 4 with the driveability needs. Finally, it guarantees the possibility of obtaining the maximum speed of the carriage 1 for a given motor, the acceleration and braking efficiency of the carriage 1 (when the latter is performed by the motor), the proper positioning of the carriage 1 on the rail during the acceleration and braking phases, the easiness of handling the carriage 1 during maintenance, an optimum setting when the dimensions of the rail vary.

The invention claimed is:

1. A motorized carriage capable of being displaced in translation along a longitudinal axis along a horizontal rail, said motorized carriage including at least one wheel driven in rotation by an electric motor and pivotally mounted along a transverse axis on a support which carries said motor, wherein said motorized carriage includes a frame integrating guide means slidably mounted on the frame along a vertical axis orthogonal to the longitudinal and transverse axes and cooperating with elastic stressing means shaped to displace the guide means towards the rail, where the support is in sliding abutment on said guide means along the longitudinal and vertical axes, this sliding abutment being designed to convert a displacement of the support along the longitudinal axis into a concomitant displacement of the support along the vertical axis towards the rail.

2. The motorized carriage according to claim 1, wherein the support includes at least one bearing element slidably mounted on a corresponding guide part integrated to the guide means, where the or each bearing element presents a bearing surface called front bearing surface adapted to come into sliding abutment on a guide ramp called front guide ramp provided on the corresponding guide part, where the front bearing surface and the front guide ramp extend in respective planes parallel to the transverse axis and inclined with respect to the longitudinal and vertical axes.

3. The motorized carriage according to claim 2, wherein the or each bearing element presents a bearing surface called rear bearing surface adapted to come into sliding abutment on a guide ramp called rear guide ramp provided on the corresponding guide part, where the rear bearing surface and the rear guide ramp are symmetrical to the front bearing surface and to the front guide ramp respectively along planes orthogonal to the longitudinal axis.

4. The motorized carriage according to claim 2, wherein the or each guide part presents front and rear guide ramps which converge towards a peak, respectively a hollow bottom, of the guide part, and the or each bearing element presents front and rear bearing surfaces which converge towards a hollow bottom, respectively a peak, of the bearing element.

5. The motorized carriage according to claim 4, wherein the or each guide part is in the form of a beveled or conical part cooperating with a bearing element having a complementary shape, or conversely, the or each bearing element is in the form of a beveled or conical part cooperating with a guide part having a complementary shape.

6. The motorized carriage according to claim 2, wherein the or each guide part is slidably mounted on the frame along the vertical axis in a corresponding guide.

7. The motorized carriage according to claim 6, wherein the elastic stressing means cooperate with the or each guide part so as to displace the corresponding guide part in translation in the direction of pressing the guide part against the corresponding bearing element of the support so as to push said support towards the rail.

8. The motorized carriage according to claim 6, wherein the or each guide part is slidably mounted inside the hollow guide secured to the frame, and the elastic stressing means include at least one elastic member interposed between a bottom wall of the guide and the corresponding guide part.

9. The motorized carriage according to claim 2, wherein the support includes a first bearing element slidably mounted on a first guide part and a second bearing element slidably mounted on a second guide part, the first bearing element and the first guide part being shifted along the longitudinal axis with respect to the second bearing element and to the second guide part.

10. The motorized carriage according to claim 9, wherein the support includes a central portion carrying the motor and on which the or each wheel is pivotally mounted, and the first and second bearing elements extend on either side of said central portion so as to cooperate in sliding abutment with the first and second guide parts.

11. A video surveillance system integrating a suspended motorized carriage movable in translation on a horizontal rail, where the motorized carriage is in accordance with claim 1 and supports at least one camera mounted on its frame.

* * * * *